US009339123B1

(12) United States Patent
Stoddard et al.

(10) Patent No.: US 9,339,123 B1
(45) Date of Patent: May 17, 2016

(54) MERCHANDISE DISPLAY

(71) Applicant: Performance Display Group, Inc., Smyrna, GA (US)

(72) Inventors: David C. F. Stoddard, Atlanta, GA (US); John A. Sgrignoli, Smyrna, GA (US); Dane Seibert, Sandy Springs, GA (US)

(73) Assignee: Performance Display Group, Inc., Smyrna, GA (US)

( * ) Notice: Subject to any disclaimer, the term of this patent is extended or adjusted under 35 U.S.C. 154(b) by 0 days.

(21) Appl. No.: 14/559,070

(22) Filed: Dec. 3, 2014

Related U.S. Application Data

(60) Provisional application No. 61/963,744, filed on Dec. 12, 2013.

(51) Int. Cl.

| | |
|---|---|
| ***A47F 5/08*** | (2006.01) |
| ***A47F 1/04*** | (2006.01) |
| ***A47F 7/00*** | (2006.01) |
| ***A47F 1/12*** | (2006.01) |
| ***A47F 5/00*** | (2006.01) |

(52) U.S. Cl.
CPC . *A47F 1/126* (2013.01); *A47F 1/04* (2013.01); *A47F 1/128* (2013.01); *A47F 5/0006* (2013.01); *A47F 5/0823* (2013.01); *A47F 5/0861* (2013.01)

(58) Field of Classification Search
CPC ..... A47F 1/126; A47F 5/0006; A47F 5/0815; A47F 5/083; A47F 5/0838; A47F 1/125; A47F 1/04; A47F 5/0861; A47F 1/128; A47F 5/0869; A47F 1/121; A47F 5/0823; A47F 5/0807; A47F 13/085; A47F 5/0876; A47F 5/0068; A47F 7/143; A47F 5/08; A47F 3/02; E05B 69/006; E05B 73/00; A47G 25/0692
USPC ..... 211/59.3, 54.1, 57.1, 59.1, 7, 4; 221/227, 255, 279
See application file for complete search history.

(56) References Cited

U.S. PATENT DOCUMENTS

| | | | | | |
|---|---|---|---|---|---|
| 4,289,242 | A * | 9/1981 | Kenyon | A47F 5/0861 | 211/4 |
| 4,474,300 | A * | 10/1984 | Entis | A47F 5/0861 | 211/4 |
| 4,475,658 | A * | 10/1984 | Roberts | A47F 5/0807 | 211/54.1 |
| 4,821,894 | A * | 4/1989 | Dechirot | A47F 1/128 | 211/54.1 |
| 5,009,334 | A * | 4/1991 | Bodkins | A47F 1/128 | 211/54.1 |
| 5,114,021 | A * | 5/1992 | Fredrickson | A47F 1/121 | 211/54.1 |

(Continued)

*Primary Examiner* — Jennifer E Novosad
(74) *Attorney, Agent, or Firm* — Rodgers & Rodgers

(57) ABSTRACT

A merchandise display having a pegboard with a support track extending therefrom, multiple packages mounted on the support track, a pusher housing in face contacting relation with the packages, a coil spring to urge the pusher housing outwardly from the pegboard, the pusher housing having spaced surfaces, and multiple slots formed in the surfaces to vary the display angle of the packages.

13 Claims, 14 Drawing Sheets

(56) References Cited

U.S. PATENT DOCUMENTS 5,131,563 A * 7/1992 Yablans ..... B65G 1/07 221/124
5,222,608 A * 6/1993 Eklof ..... A47F 52/0869 211/54.1
5,641,077 A * 6/1997 Tufano ..... A47F 1/128 211/54.1
5,671,851 A * 9/1997 Johnson ..... A47F 5/0869 211/106
5,906,283 A * 5/1999 Kump ..... A47F 1/128 211/54.1
6,102,192 A * 8/2000 Tomuro ..... A47F 1/128 198/747
6,131,748 A * 10/2000 Kawasaki ..... A47F 1/128 211/54.1
6,158,598 A * 12/2000 Josefsson ..... A47F 1/121 211/54.1
6,474,478 B1 * 11/2002 Huehner ..... A47F 5/0861 211/4
6,622,979 B2 * 9/2003 Valiulis ..... A47F 5/0861 211/59.1
7,520,394 B2 4/2009 Rosen
7,533,784 B2 * 5/2009 Vlastakis ..... A47F 5/0861 221/151
7,566,037 B2 * 7/2009 Vogler ..... A47F 1/128 211/54.1
7,584,930 B2 * 9/2009 Zich ..... A47F 5/0861 211/57.1
7,905,364 B2 * 3/2011 Pail ..... A47F 1/128 211/59.3
7,918,352 B2 * 4/2011 Rosen ..... A47F 5/0006 211/113
8,240,486 B2 * 8/2012 Niederhuefner ..... A47F 1/128 211/51
8,534,469 B2 * 9/2013 Northrup, Jr. ..... A47F 5/0861 211/57.1
8,739,980 B2 * 6/2014 Valiulis ..... A47F 1/128 211/54.1
2005/0072746 A1 * 4/2005 O'Brien ..... A47F 5/0823 211/59.1
2006/0157431 A1 * 7/2006 Nagelski ..... A47F 5/0861 211/54.1

* cited by examiner

MERCHANDISE DISPLAY

The benefits under 35 U.S.C. 119 are claimed of provisional patent application 61/963,744 filed Dec. 12, 2013.

FIELD OF THE INVENTION

This invention relates to retail merchandising equipment such as displays, racks and gondolas that present the merchandise in an optimal way to make the merchandise easy to find, recognize, select and compare when consumers shop and to provide easy installation, upkeep and reconfiguration of retail equipment by retail merchandisers. The merchandise display is well suited for but not exclusive to merchandise packaged using typical paperboard or plastic materials and standard packaging methods.

BACKGROUND OF THE INVENTION

Retail stores methodically offer merchandise along aisles, open spaces, counters, showcases and gondolas often congested by shoppers, shopping carts, store employees, vendors, route personnel, restocking racks, product feature racks and seasonal and promotional displays. Searching for merchandise conventionally displayed in a vertical arrangement is often inconvenient to the shopper and requires close proximity of the customer to the display equipment in order to view and/or remove the package. In some cases, reaching, squatting, kneeling or stretching is necessary in an attempt to make a selection. This invention allows and aids in the process of selecting and removing merchandise for purchase. Multiple merchandise packages utilizing this invention and displayed together are automatically repositioned for ease of selection by the next shopper.

When store situations require a shopper to be extremely close to displayed merchandise, the lower rows of packages may be obstructed from the shopper's view by merchandise packages in rows above the sought item thereby hampering the opportunity for purchase. Current equipment may not automatically advance merchandise items to the position closest to the shopper, further restricting the shopper's ability to easily find the desired item.

Also, this invention enhances housekeeping, replenishment of inventory and aids in maintaining a neat and efficient merchandise arrangement. Brand presence and differentiation are enhanced and replenishment needs are immediately obvious. The shopping experience becomes more efficient, selection of merchandise is easier and the opportunity for purchase is quickly realized. In addition, packages are easily viewed and competing brands will not be readily noticed for removal and purchase. Marketers using the display will benefit from the ease consumers will have in being able to find and select the desired merchandise. Product visibility is improved and there is no need to squat or kneel in order to find and select merchandise.

BRIEF SUMMARY OF THE INVENTION

A typical displayed package includes a slot located near its uppermost edge which may be a simple elongated horizontal opening, an inverted T-shaped opening or a triangular opening. The geometry of each opening is easily accommodated by a package support track which may be solid plastic or metal or may be a fabricated wire in the form of a loop or cylindrical rods. The package supporting track is attached to a back plate which typically includes two curved rear hooks that engage a retail support panel. The retail industry refers to such devices as peg hooks varying in length, material strength and informative pricing signage or labels. The curved hooks engage perforations or openings in commonly used supporting means such as pegboard, a sheet of fiberboard or plastic nominally ¼-inch in thickness or a wire grid, consisting of parallel metal wire or rod elements that allow for insertion of the curved hooks. An alternative arrangement includes an angle flange of a peg hook back plate between horizontal pairs of metal wires, slat wall wood composition boards or metal or plastic panels that have horizontal openings with a recess above and below the openings to receive the curved hooks of the peg hook.

The merchandise display is manufactured of plastic, metal sheet or metal wire, or combinations of both, and embodies a product track with an upturned end, a back plate with hooks which engage a support such as a pegboard, a pusher plate located behind merchandise packages disposed on the product track which is activated by a coiled spring. Although the elements are similar to existing displays, the pusher plate of this invention is configured to orient the merchandise product packages into an optimal position for consumer viewing thus enhancing the selection process and merchandising efficiency. There are two basic elements, i.e., the spring as a pusher and a pusher housing containing the spring which has several adjustable attitudes that position product packages either with the packages parallel to the retail supporting panel (a plumb position) or with the top of the packages tilted towards the retail supporting panel with the lower edge of the packages inclined toward the consumer. In each case, the package is always in a position to be easily removed by a consumer and is always fronted to provide a uniform, attractive, well-organized appearance to the consumer, and acts as an aid in product replenishment and retail housekeeping. The spring as a pusher has the benefit of the lowest cost and the pusher housing including spring provides the best possible viewing attitudes for the consumer, either plumb or tilted. Some retailers may use combinations of varying package orientation on the same display.

The product support track is plastic, sheet metal or metal wire for use with the attitude positioning properties of the pusher. The product support track may be ganged or grouped into assemblies of 2, 3, 4 or more tracks, each with its own pusher. For the best viewing positions, retailers may decide to configure a display with upper rows of peg hooks in a vertical or plumb position and lower rows in tilt back position allowing all product packages to be easily viewed, selected, maintained and replenished.

Additional properties of the merchandise display include the distinct relationship of the hook portion of the back plate and the pegboard-type of retail support panel. Hole patterns in pegboards are usually horizontal rows and vertical columns. Some retail configurations may use the center of the back panel aligned vertically on the centerline of the pegboard holes. Other retail configurations may use the center of the back panel to be aligned on the center of the space between horizontal holes. Each configuration is addressed by a separated geometrical arrangements of hooks. Some retailers desire the ability to reposition the peg hooks without removing the product from the peg hook assembly. The hooks of this invention are essentially inserted with a slight tilt of the total peg hook allowing engagement of the hook into the pegboard. This is accomplished without removing hooks above or below or without removing product packages from the product support track being inserted or from tracks which may already be inserted in the pegboard.

DETAILED DESCRIPTION OF THE SEVERAL VIEWS OF THE DRAWINGS

DETAILED DESCRIPTION OF THE INVENTION

Figure 1:
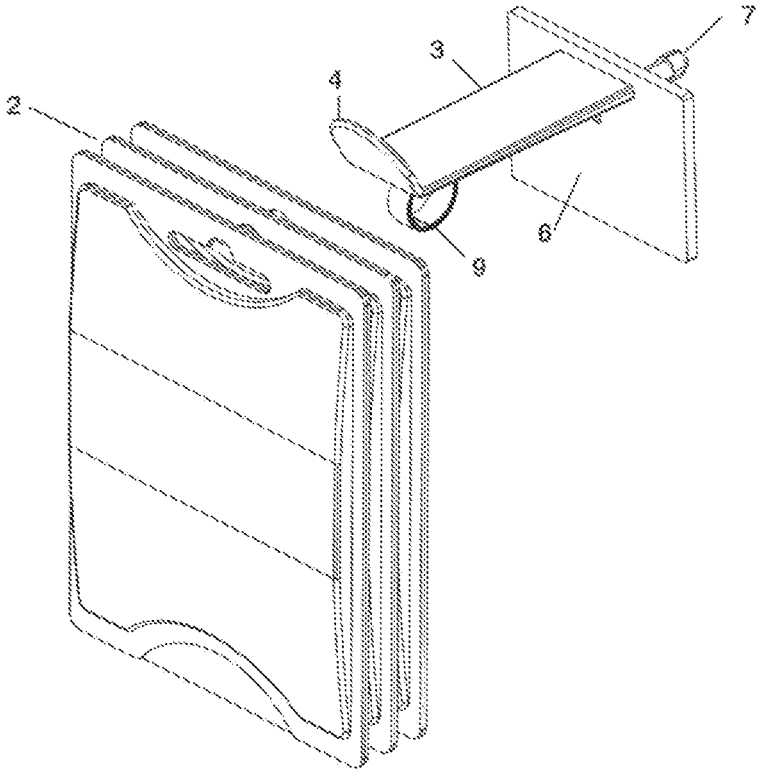
FIG. 1 is an exploded perspective view of the basic embodiment of the merchandise presentation display according to this invention.

In FIG. 1, a pusher peg hook merchandising display is shown and includes product support track 3, upwardly angled tip 4, integral back panel 6, a straight-in hook 7, attached coil spring 9 and merchandise packages 2. In this basic embodiment, coil spring 9 acts as a pusher to move packages toward angled tip 4 after the packages are loaded onto product support track 3. The embodiment of FIG. 1 provides the retail industry with the lowest cost configuration of the merchandise display.

Figure 2:
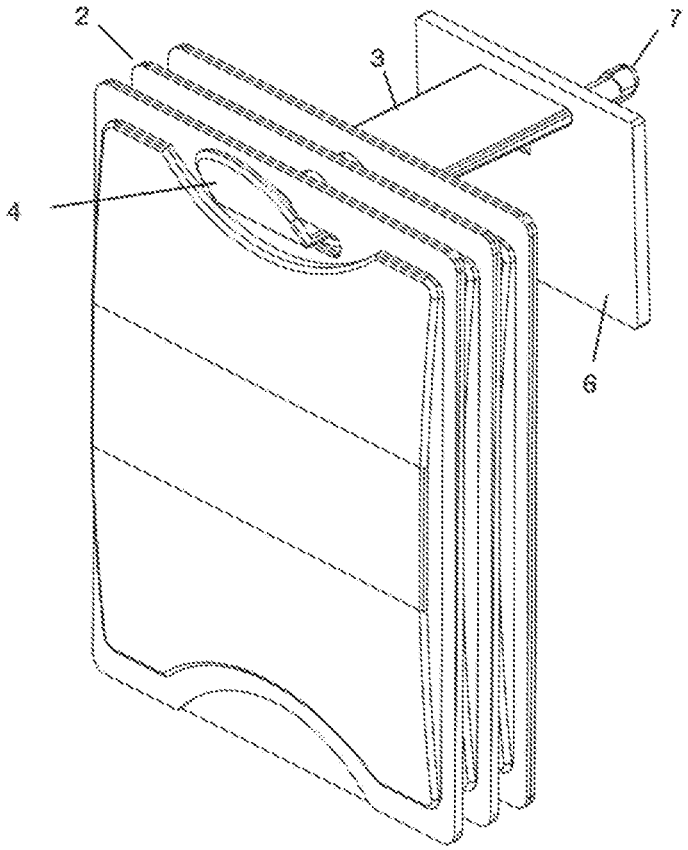
FIG. 2 is a perspective of the display with the packages in a displayed configuration.

FIG. 2 shows merchandise packages 2 loaded on product support track 3 and moved into the forward position by tension applied by coil spring 9. Packages 2 are then ready for selection by consumers, but restrained from being propelled off support track 3 by means of upwardly angled tip 4 of support track 3.

Figure 3:
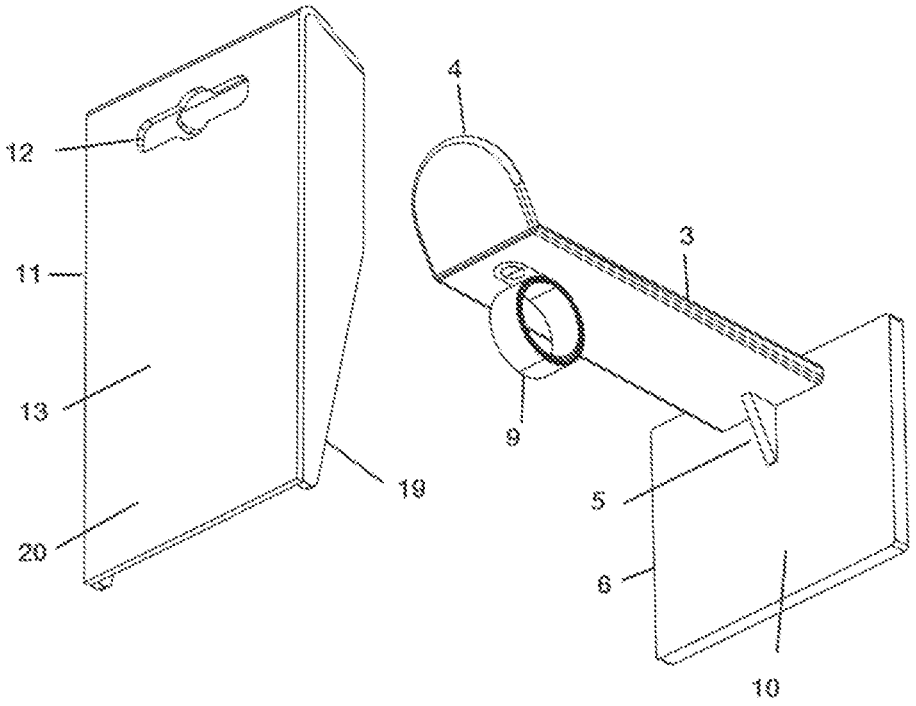
FIG. 3 is an exploded perspective view of the support track element of the display.

FIG. 3 shows product pusher housing 11 including front slot 12, product control surface 13, which also functions to include space 20 for optional retail advertising. Gusset 5 reinforces the junction of support track 3 and back panel 6. Coil spring 9 is attached to the underside of support track 3 by heat staking or by use of an eyelet, hollow rivet and the like.

Figure 4:
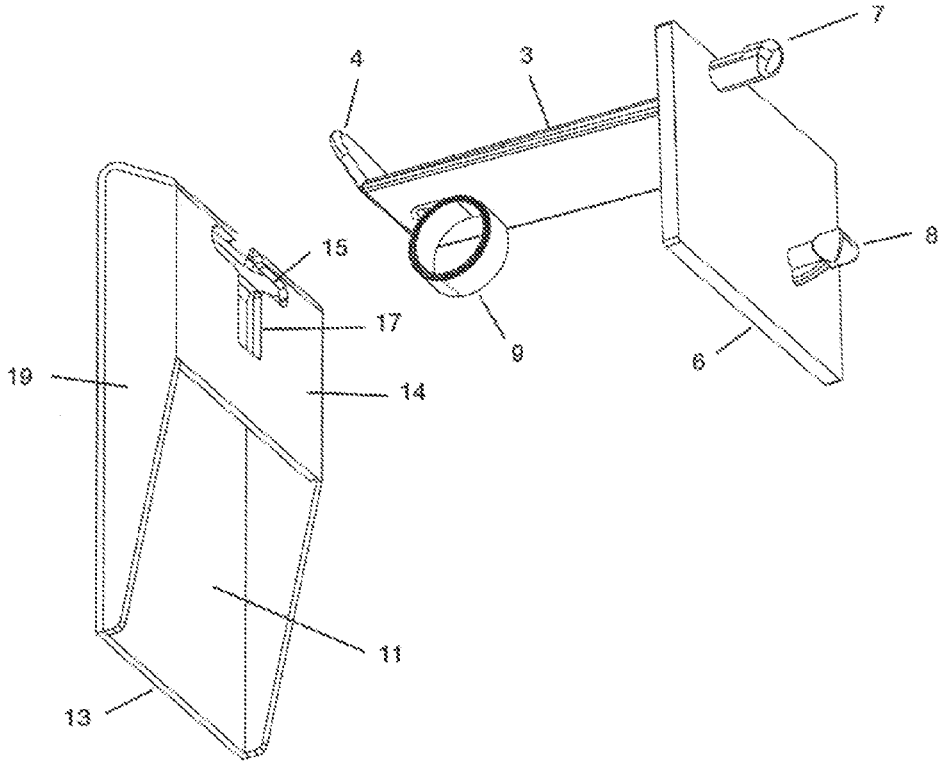
FIG. 4 is an exploded perspective view of the support track shown in FIG. 3 shown from below.

FIG. 4 depicts the lower rear side of product pusher housing 11 with stiffening sides 19, rear vertical attitude surface 14 with rear slot 15 formed therein and vertical slot 17 disposed generally perpendicular to rear slot 15 and extending downwardly therefrom. Vertical slot 17 allows coil spring 9 to extend therethrough and into abutting relation with the inner surface of product control surface 13 of product pusher housing 11, which assists in proper tracking of moving packages with efficient utilization of package display space along support track 3. Back panel 6 includes a straight-in hook 7 and a straight-in stud 8 extending outwardly and rearwardly therefrom. The alignment of hook 7 and stud 8 is arranged to fit into horizontally and vertically spaced holes in a typical retail display pegboard. The offset allows the centerline of product support track 3 to correspond to the corresponding centerline of the space between horizontal holes in retail display pegboard panels.

Figure 5:
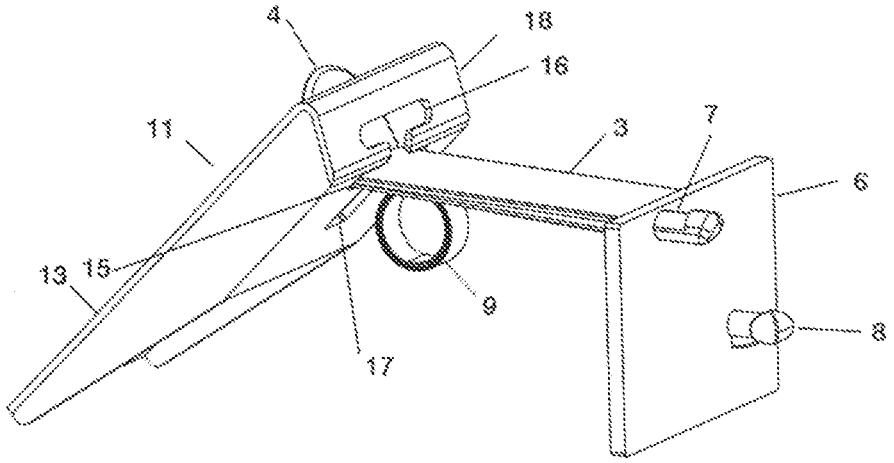
FIG. 5 is a perspective view similar to FIG. 4 with a package partially inserted on the support track.

In FIG. 5, for vertical package attitude, angled tip 4 initially is inserted into rear slot 15. Angled tip 4 of support track 3 is then extended through front slot 12 of pusher housing 11 and package 2 is moved rearwardly to the position shown in FIG. 6.

Figure 6:
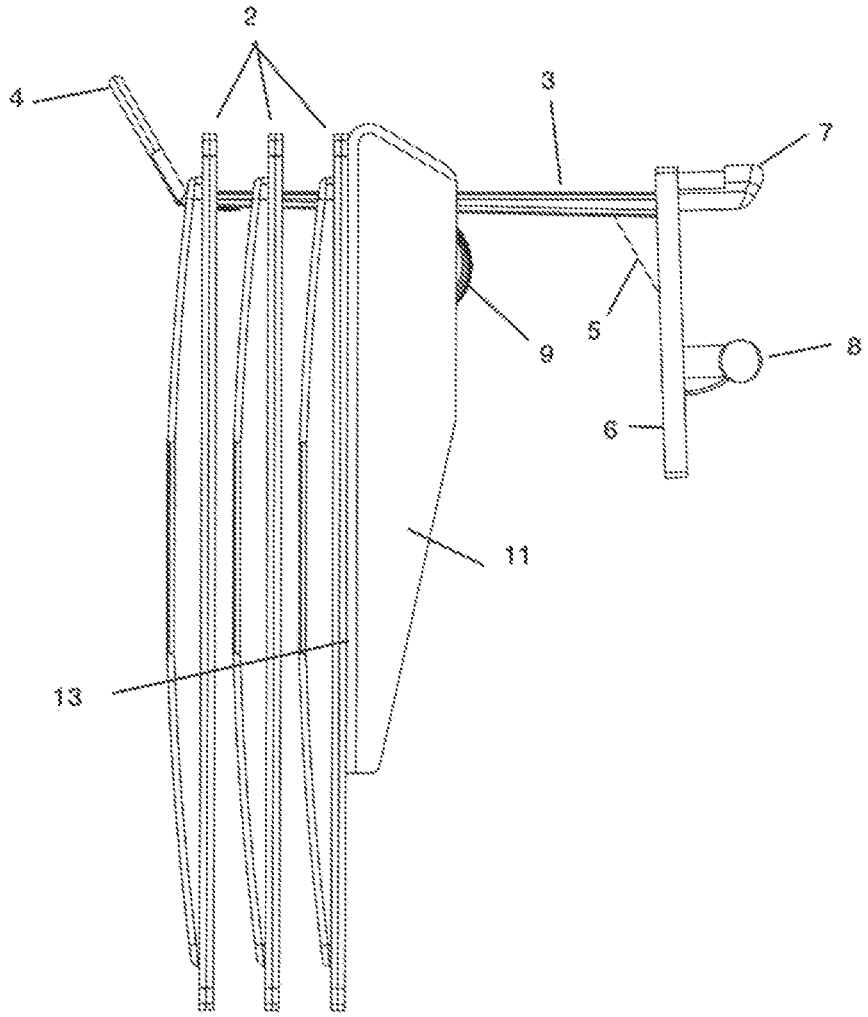
FIG. 6 is a side elevational view with the packages loaded onto the support track.

FIG. 6 shows the completed installation and placement of merchandise packages 2 on support track 3. Coil spring 9 then enters pusher housing 11 through vertical slot 17 and the merchandise packages 2 are thereby propelled toward the end of track 3 for selection by consumers. Merchandise packages 2 are retained in position by a combination of angled tip 4 and the tension exerted by spring coil 9.

Figure 7:
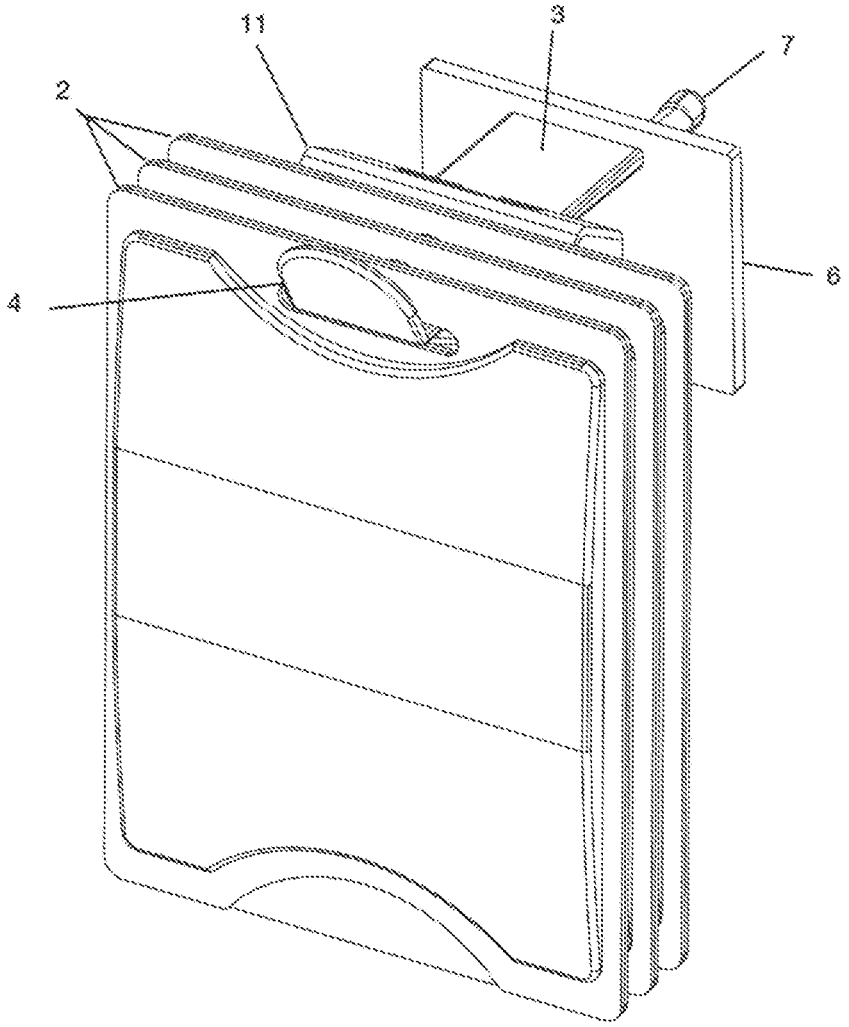
FIG. 7 is perspective view of the display shown in FIG. 6.

FIG. 7 shows the consumer's view with merchandise packages 2 retained by angled tip 4 and controlled by pusher housing 11.

Figure 8:
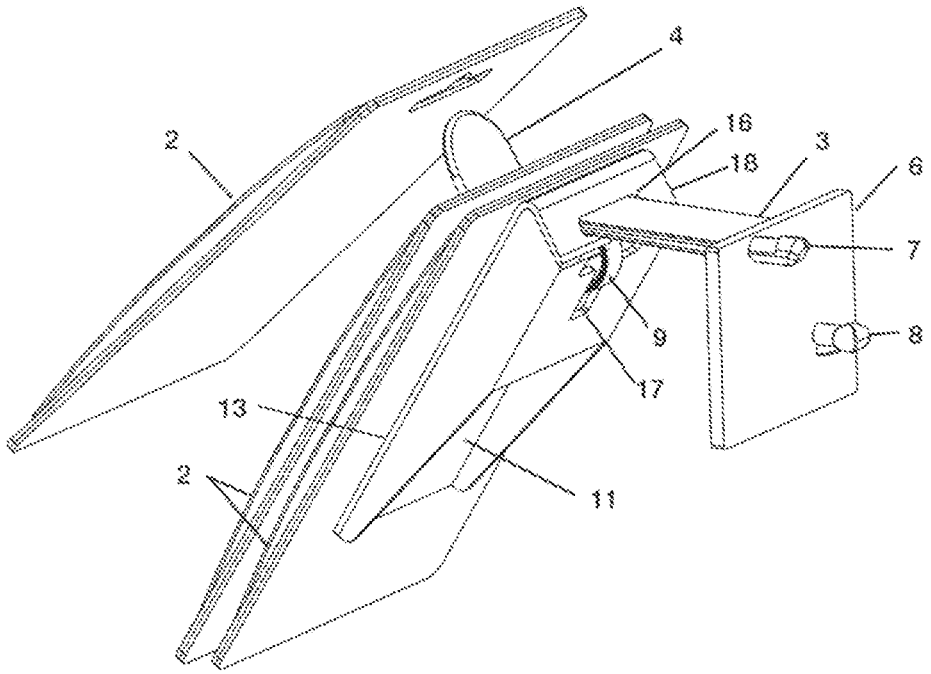
FIG. 8 is a rear perspective view of the display with the packages in a tilted configuration.

FIG. 8 is a rear view of the display with merchandise packages 2 in a tilted or angled attitude. Support track 3 extends through the tilt slot 16 formed in rear panel 18. Rear panel 18 is integrally joined along its side edges to the respective upper edges of product control surface 13 and rear vertical attitude surface 14. Coil spring 9 is engaged in vertical slot 17 which insures proper tracking. One package 2 is shown in a position for removal or replenishment. The surface rear panel 18 has a dimensional relationship with product control surface 13 of pusher housing 11 which allows angled tip 4 to extend through front slot 12 and tilt slot 16 which determines the angle of package tilt.

Figure 9:
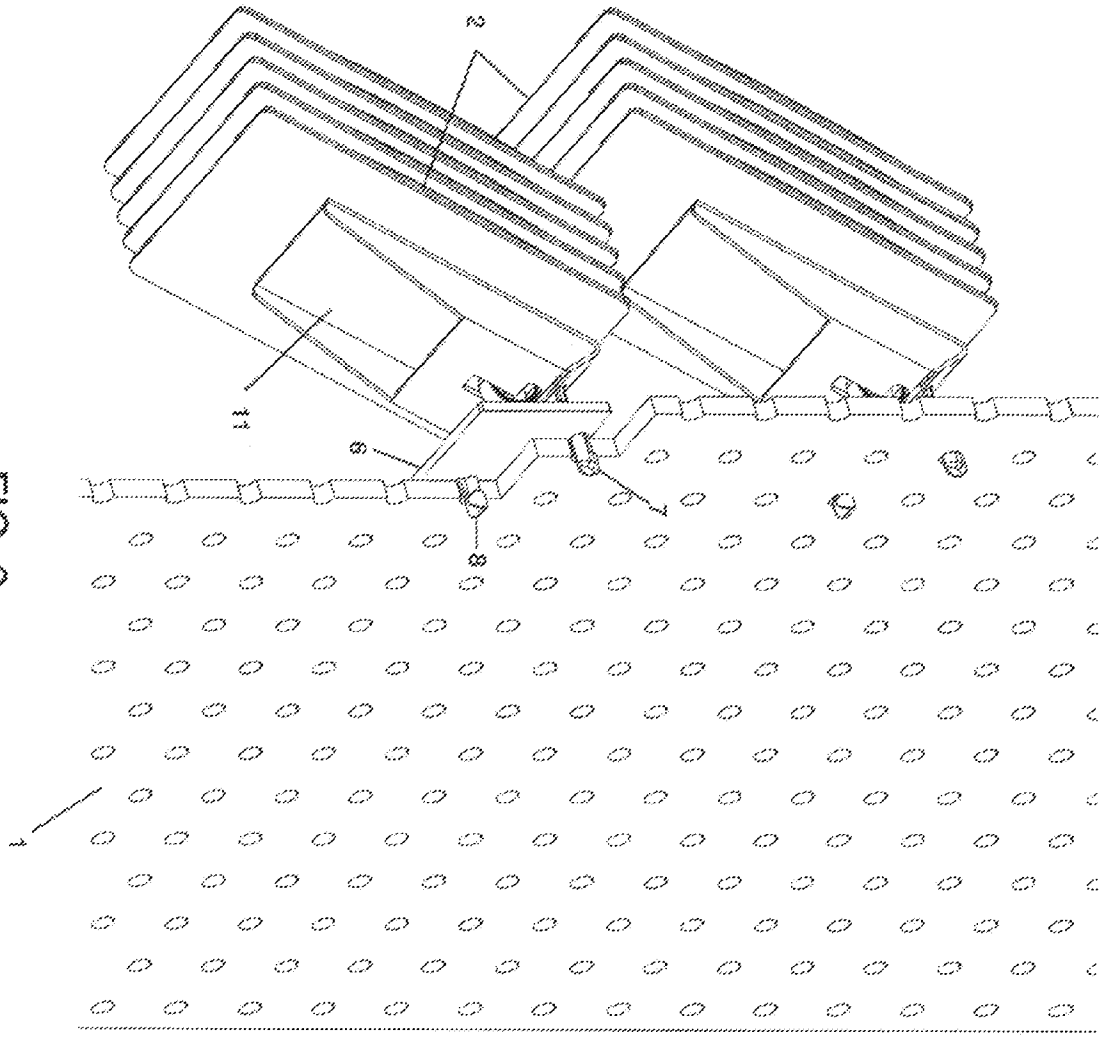
FIG. 9 is a rear perspective view depicting the packages affixed to a display pegboard.

FIG. 9 shows packages 2 installed on retail display pegboard 1 in vertical tandem. The retail display pegboard 1 is conveniently shown cutaway to illustrate the engagement of straight-in hook 7 and straight-in stud 8 so arranged to allow centerline of package 2 to align with the centerline of the space between horizontal holes in the retail display pegboard 1.

Figure 10:
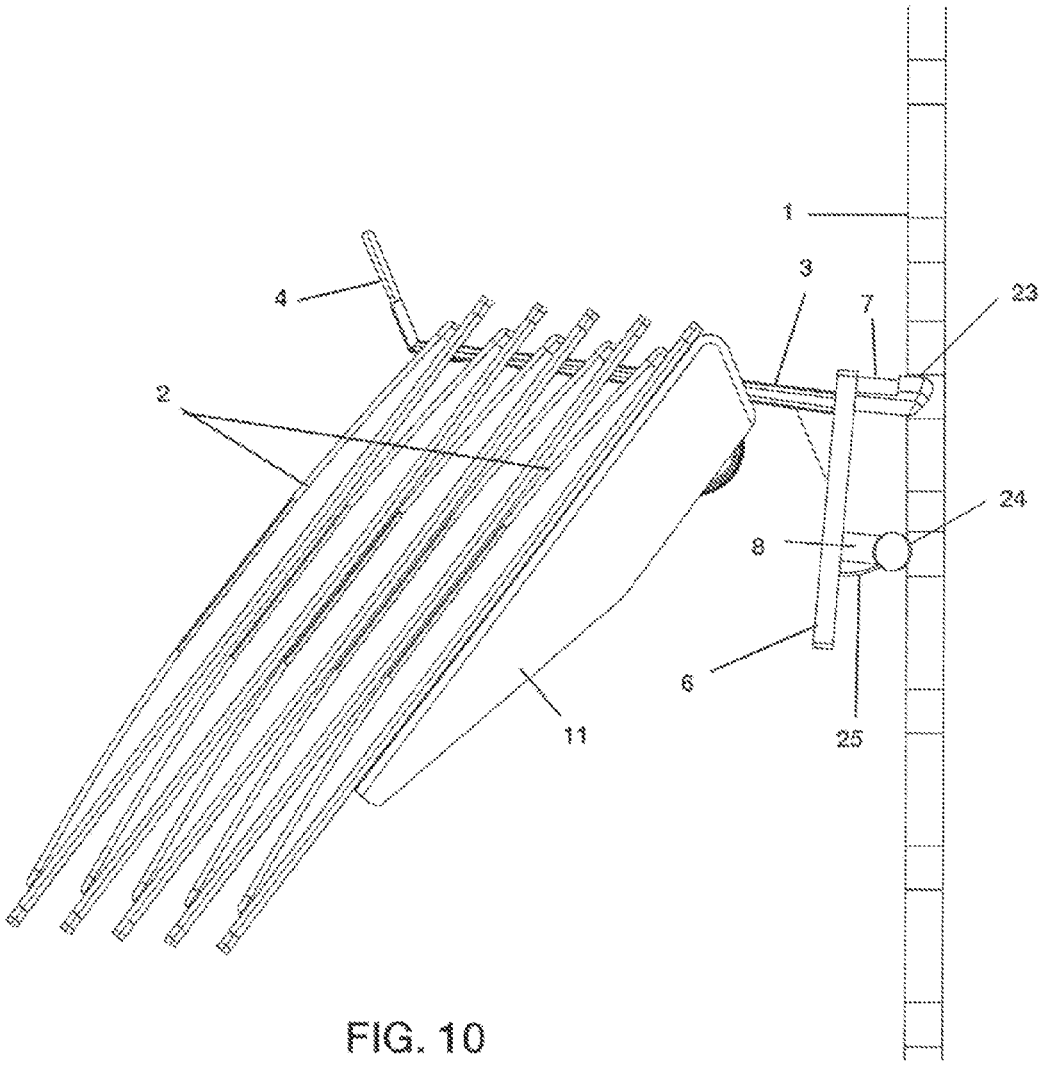
FIG. 10 is a side elevational view thereof showing insertion of the support track into a display pegboard.

FIG. 10 depicts the attachment feature of support track 3. In order to secure support track 3 to pegboard 1, support track 3 is rotated slightly upwardly which allows the insertion of straight-in hook 7 on pegboard 1 and then rotated downwardly to allow straight-in stud 8 to be inserted into a corresponding hole in display pegboard 1. Standard retail industry practice includes the rearrangement of merchandise packages for seasonal, introductory or marketing purposes. Reversing the insertion of the straight-in elements allows removal of support track 3 without disturbing or removing vertically adjacent merchandising packages 2. Straight-in hook 7 has a projecting cylindrical knob 23 which is forced upward as the straight-in stud 8 is inserted into its hole in pegboard 1. A rounded knuckle 24 on stud 8 eases insertion and cam lobe 25 is disposed in a tensional relation with the pegboard material surrounding the hole thereby securing hook 7 and stud 8 in a snug manner.

Figure 11:
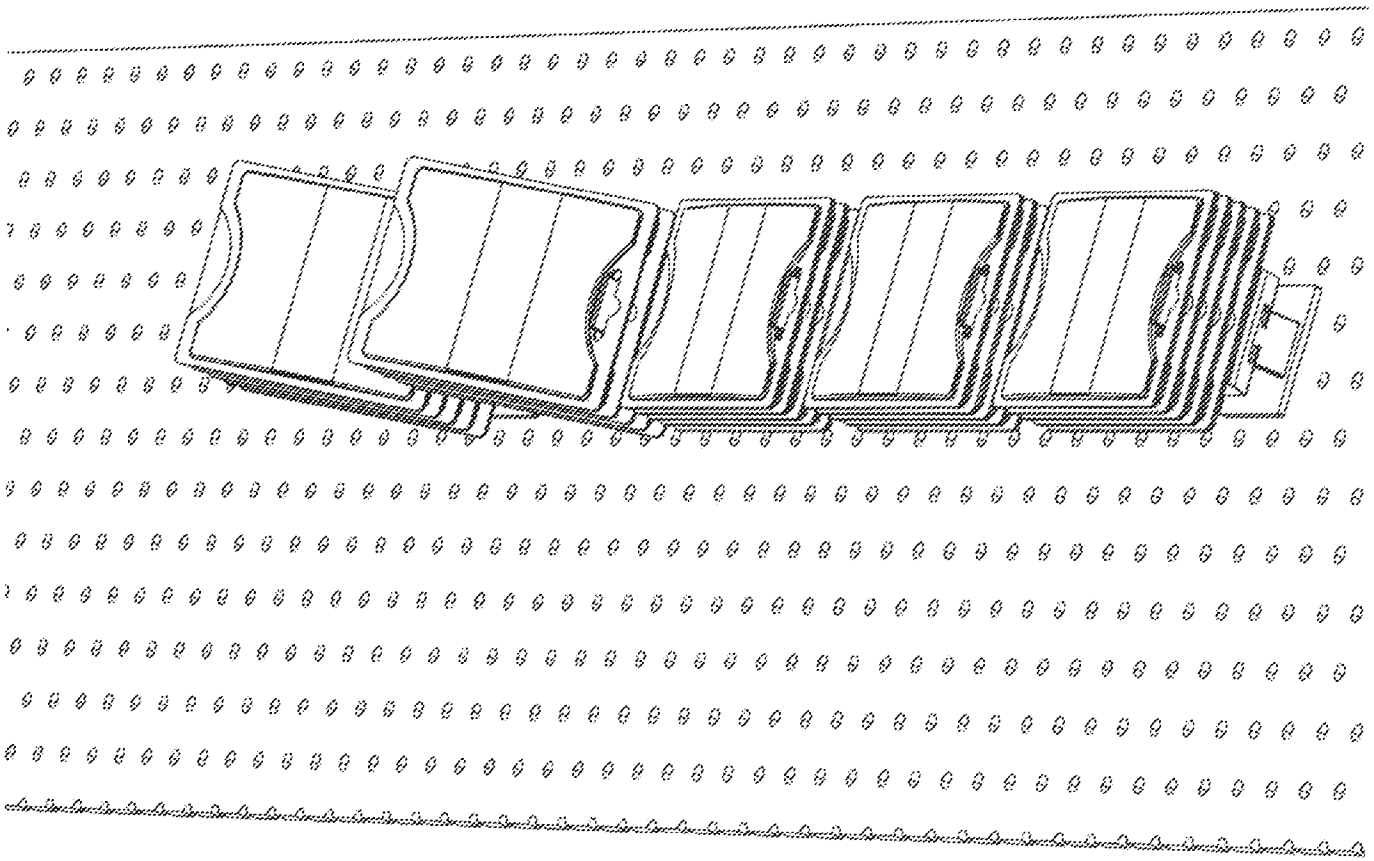
FIG. 11 is a perspective view showing multiple packages in a vertically displayed arrangement.

FIG. 11 shows the visual arrangement of merchandising packages using the vertical attitude positioning of product pusher housing 11 located above and the tilted attitude for merchandising packages positioned lower on display pegboard 1 so that all the merchandising packages can be easily viewed for selection. Lower packages are not obscured from a consumer's view.

Figure 12:
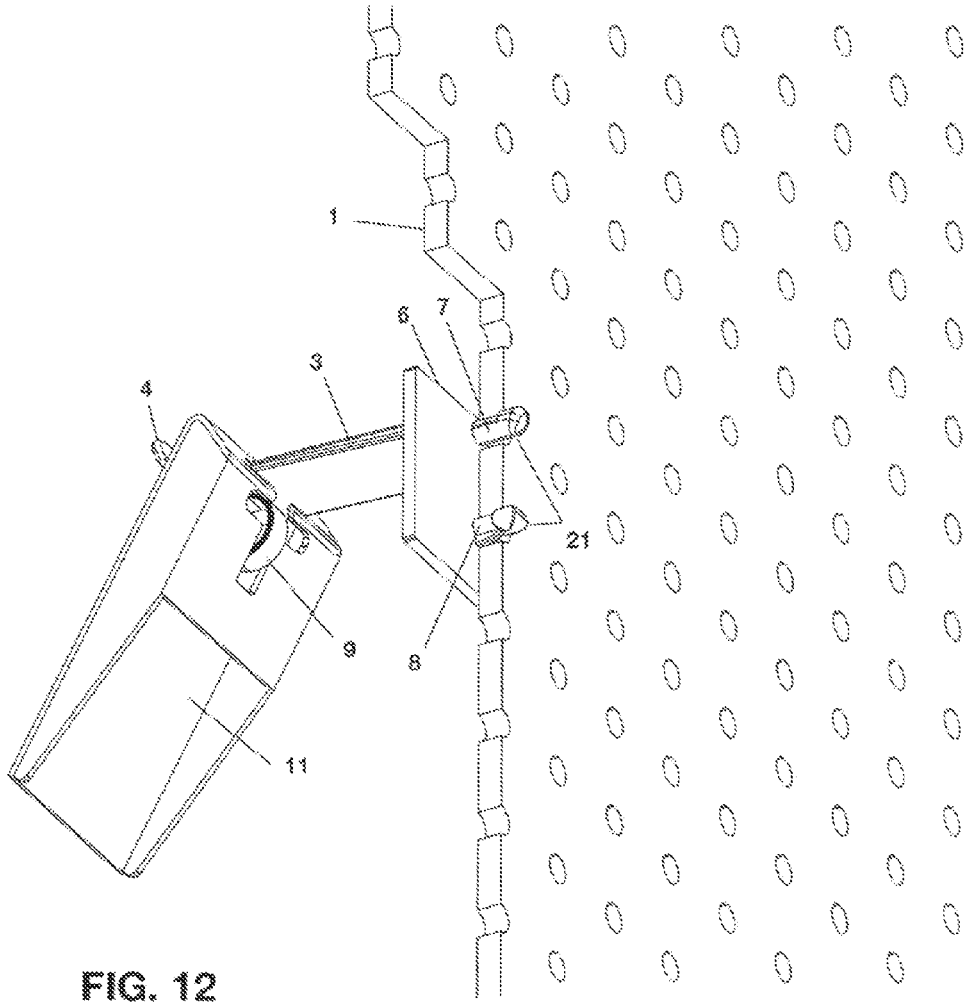
FIG. 12 is a perspective view from below showing an alternative arrangement of the display.

In FIG. 12, an alternative configuration is shown from below installed on retail pegboard 1 wherein hook 7 and stud 8 are vertically aligned with the centerline of support track 3 aligned with the centerline of the vertically aligned pegboard holes. Positioning merchandising packages on either the center of the space between horizontal holes in the retail display pegboard 1 or on a vertical hole alignment is accomplished by the two configurations of straight-in hook 7 and straight-in stud 8.

Figure 13:
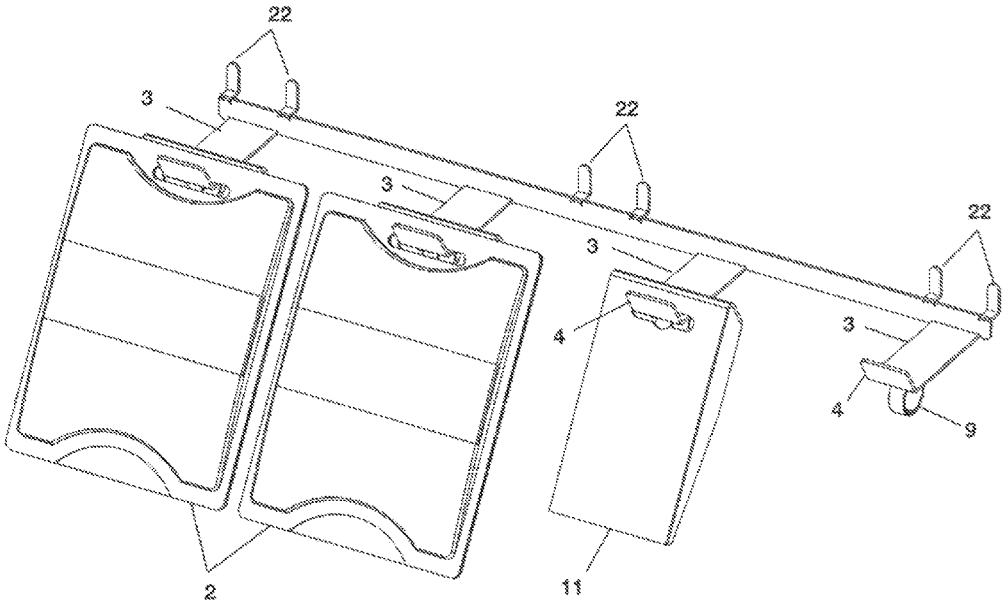
FIG. 13 is a perspective view of a multiple combination package display.

FIG. 13 shows an adaptation of pusher housing 11 in a ganged metal arrangement of product support tracks. Both vertical and tilted back attitudes are maintained on a ganged metal device. Coil springs 9 are attached to metal support tracks and standard peg prongs 22 engage retail pegboard 1.

Figure 14:
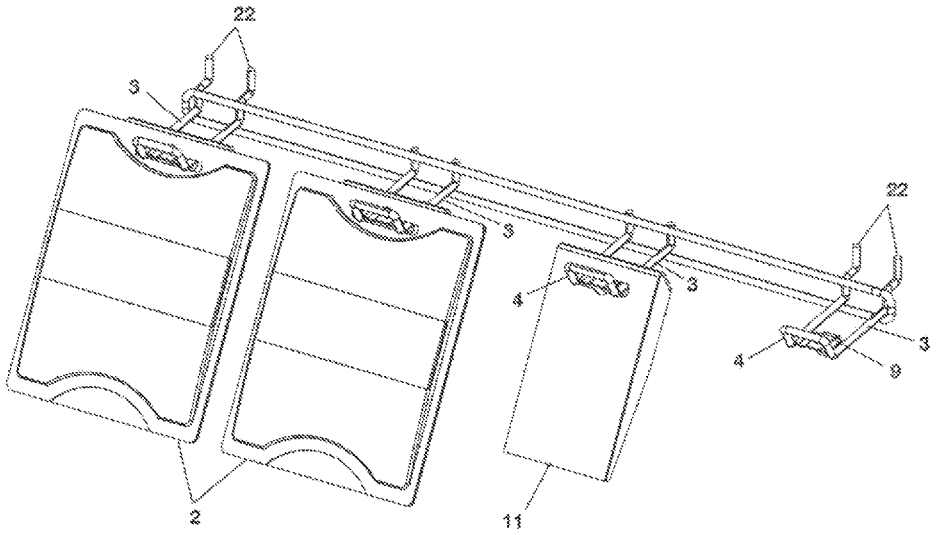
FIG. 14 is a perspective view similar to that shown in FIG. 13.

FIG. 14 depicts an adaptation of pusher housing 11 to a ganged metal wire loop arrangement of support tracks 3. Both vertical and tilted attitudes are maintained on a ganged metal wire loop device. Coiled springs 9 are attached to metal wire loop support tracks and standard peg prongs 22 engage retail pegboard 1.

The invention claimed is:

1. A merchandise display comprising a back panel, a support track having a free end and extending outwardly from said back panel, said free end being opposite said back panel, said free end being angled upwardly, a coil spring secured to the underside of said support track, a package having an aperture formed in the upper portion thereof, said support track extending through said aperture, said coil spring being adapted to urge said package toward said free end, a pusher housing slidable on said support track and comprising a product control surface and an attitude surface spaced apart and being generally parallel, a front slot formed in said product control surface, said product control surface and said attitude surface comprising spaced upper end edges, a rear panel extending between said upper edges and joined thereto, a tilt slot formed in said rear panel, and a vertical slot formed in said rear panel and extending downwardly into said attitude surface.

2. The display according to claim 1 wherein a display pegboard is secured to said back panel.

3. The display according to claim 2 wherein said back panel comprises a rear surface and wherein a hook extends outwardly from said rear surface into interlocking relation with said display pegboard.

4. The display according to claim 3 wherein a stud extends outwardly from said rear surface into interlocking relation with said display pegboard.

5. The display according to claim 4 wherein said hook and said stud are offset vertically.

6. The display according to claim 4 wherein said hook and said stud are vertically aligned.

7. The display according to claim 4 wherein a knuckle is disposed on the free end of said stud and a cam lobe is attached to said stud and is in a tensional relation with said pegboard.

8. The display according to claim 3 wherein a knob is disposed adjacent the free end of said hook and extends laterally outwardly therefrom.

9. The display according to claim 1 wherein said pusher housing is disposed between said package and said back panel and in face contacting relation with said package.

10. The display according to claim 1 wherein a rear slot is formed in said attitude surface and wherein said support track extends through said front and rear slots.

11. The display according to claim 10 wherein said rear slot is in communication with said vertical slot.

12. The display according to claim 1 wherein said coil spring extends through said vertical slot and is disposed generally between said product control surface and said attitude surface.

13. The display according to claim 1 wherein said product control surface and attitude surface respectively comprise side edges and a pair of stiffening sides are joined, respectively, to said side edges on each side of said pusher housing.

* * * * *